US007799998B2

(12) United States Patent
Alexander

(10) Patent No.: US 7,799,998 B2
(45) **Date of Patent: *Sep. 21, 2010**

(54) CABLE AND ARTICLE DESIGN FOR FIRE PERFORMANCE

(75) Inventor: Graeme Alexander, Victoria (AU)

(73) Assignee: Olex Australia Pty Ltd, Tottenham, Victoria (AU)

( * ) Notice: Subject to any disclaimer, the term of this patent is extended or adjusted under 35 U.S.C. 154(b) by 138 days.

This patent is subject to a terminal disclaimer.

(21) Appl. No.: 11/930,373

(22) Filed: Oct. 31, 2007

(65) Prior Publication Data

US 2008/0124544 A1 May 29, 2008

Related U.S. Application Data

(63) Continuation of application No. 10/551,662, filed as application No. PCT/AU2004/000410 on Mar. 31, 2004, now Pat. No. 7,304,245.

(30) Foreign Application Priority Data

Mar. 31, 2003 (AU) ..... 2003901872
Oct. 21, 2003 (AU) ..... 2003905779

(51) Int. Cl.
*H01B 7/00* (2006.01)

(52) U.S. Cl. ..... 174/110 R; 174/113 R

(58) Field of Classification Search ..... 174/110 R, 174/110 A–110 E, 113 R, 120 R, 121 R, 174/121 A, 122 R
See application file for complete search history.

(56) References Cited

U.S. PATENT DOCUMENTS

| | | | | |
|---|---|---|---|---|
| 3,576,940 | A * | 5/1971 | Stone et al. | 174/113 R |
| 4,367,295 | A * | 1/1983 | von Bonin | 521/165 |
| 4,992,481 | A * | 2/1991 | von Bonin et al. | 521/54 |
| 5,597,981 | A * | 1/1997 | Hinoshita et al. | 174/110 R |
| 7,049,524 | B2 * | 5/2006 | Belli et al. | 174/120 R |
| 2005/0113500 | A1 * | 5/2005 | Okoshi et al. | 524/405 |

FOREIGN PATENT DOCUMENTS

| | | | |
|---|---|---|---|
| EP | 0559382 | A1 * | 2/1993 |
| JP | 11-297128 | A * | 10/1999 |

* cited by examiner

*Primary Examiner*—William H Mayo, III
(74) *Attorney, Agent, or Firm*—Whitham Curtis Christofferson & Cook, PC

(57) ABSTRACT

A cable (1) has a conductor (3), an insulating layer (2) which forms a self-supporting ceramic layer when exposed to elevated temperatures experienced in a fire, and an additional heat transformable layer (4). The additional layer (4) can be another layer which forms a self-supporting ceramic layer when exposed to fire, or it can act as a sacrificial layer which decomposes at or below the temperature that the insulating layer forms a ceramic. The addition layer can enhance the strength of the layers before, during or after the fire, the structural integrity of the insulting layer (2) after the fire, the resistance of the layers to the ingress of water after the fire, or the electrical or thermal resistance of the layers during and after the fire.

19 Claims, 2 Drawing Sheets

CABLE AND ARTICLE DESIGN FOR FIRE PERFORMANCE

This application is continuation application with Ser. No. 10/551,662, which was filed on Jun. 2, 2006, now U.S. Pat. No. 7,304,245 based on international application PCT/AU2004/000410 filed on Mar. 31, 2004. The application PCT/AU2004/00410 in its turn claims priority to two Australian applications 20033901872 and 2003905779.

FIELD OF THE INVENTION

This invention relates to electrical cables and articles having at least one ceramic forming layer, insulating or protecting a metal substrate, and, in particular, to the design and manufacture of these cables and articles and their use.

BACKGROUND OF THE INVENTION

There are numerous situations where it is desirable to design a product which contains a metal substrate and is resistant to fire. For instance, fire performance cables are required to continue to operate and provide circuit integrity when they are subjected to fire. To meet some of the standards, cables must typically maintain electrical circuit integrity when heated to a specified temperature (e.g. 650, 750, 950, 1050[deg.] C.) in a prescribed way for a specified time (e.g. 15 minutes, 30 minutes, 60 minutes, 2 hours). In some cases the cables are subjected to regular mechanical shocks, before, during and after the heating stage. Often they are also subjected to water jet or spray, either in the latter stages of the heating cycle or after the heating stage in order to gage their performance against other factors likely to be experienced during a fire.

These requirements for fire performance cables have been met previously by wrapping the conductor of the cable with tape made with glass fibres and treated with mica. Such tapes are wrapped around the conductor during production and then at least one insulative layer is subsequently applied. Upon being exposed to increasing temperatures, the outer insulative layers are degraded and fall away, but the glass fibres hold the mica in place. These tapes have been found to be effective for maintaining circuit integrity in fires, but because of the additional manufacturing steps they are quite expensive to produce. Further the process of wrapping the tape around the cable is relatively slow compared to other cable production steps and thus, wrapping the tape slows overall production of the cable further adding to the costs. Attempts have been made to reduce the costs by avoiding the use of tape and extruding a cable coating consisting of a flexible polymeric composition which forms an insulating ceramic when exposed to fire to provide the continuing circuit integrity.

Such ceramic forming compositions are known in the prior art. For example, U.S. Pat. No. 4,269,753 and U.S. Pat. No. 4,269,757 describe coatings of ceramic forming compositions being applied directly to a short length of copper wire. When the coated wire is exposed for 30 minutes to air, at 850[deg.] C., the coatings are said to form a strong and hard ceramic substance without any cracks and without separating from the copper wire. U.S. Pat. No. 6,387,512 shows application of a ceramic forming coating to an electrical conductor and the retention of circuit integrity when this is heated for 2 hours at 930[deg.] C. with an applied potential of 500 volts. International Application No. PCT/AU2003/00968 in the name of Polymers Australia Pty Ltd discloses a silicone polymer based ceramic forming composition suitable for cables and other applications which forms a self supporting ceramic material when heated to an elevated temperature. International Application No. PCT/AU2003/01383 also in the name of Polymers Australia Pty Ltd discloses a self supporting ceramic forming composition suitable for cables and other applications which exhibit little, or no shrinkage, when exposed to the kind of elevated temperatures associated with a fire.

While the ceramic forming compositions of the prior art, in theory, are able to provide the required electrical and/or thermal insulation, the other physical properties of ceramic forming compositions, both before and after exposure to elevated temperatures, make the practical application of these materials, particularly in cable applications, difficult to implement with compromises needing to be made to accommodate the less than ideal physical properties. Ideally the ceramic forming layer should be able to accommodate the mismatch between the thermal coefficients of expansion of the metal substrate and the ceramic forming composition during the increasing temperatures experienced during a fire and the decreasing temperatures after the fire, have adequate mechanical properties before, during and after exposure to elevated temperatures, maintain its structural integrity and where necessary provide an adequate water barrier, particularly during and after exposure to elevated temperatures.

Hence it is an object of the invention to provide a fire performance cable or fire performance article from a ceramic forming material on a metal substrate which overcomes one or more of the practical problems associated with using ceramic forming materials.

SUMMARY OF THE INVENTION

According to one aspect, the invention provides a cable comprising at least one conductor, an insulating layer which forms a ceramic when exposed to an elevated temperature and at least one heat transformable layer which enhances the physical properties of the insulating ceramic forming layer when exposed to an elevated temperature.

The applicant has found that by providing at least one further heat transformable layer, deficiencies in the properties of the ceramic forming layer, during and after exposure to an elevated temperature can be accommodated by this additional heat transforming layer. The provision of this at least one additional layer enhances the overall properties of the cable when the cable is exposed to the elevated temperatures which would normally be experienced in a fire.

In a preferred form of the invention, the at least one heat transformable layer is co-extruded onto the conductor with the insulating layer. The at least one heat transformable layer may be able to improve, compensate for, or overcome problems associated with the ceramic forming material when used in a cable design.

The insulating layer may be formed from a variety of compositions. Preferably, the insulating layer is formed from a composition which forms a ceramic when exposed to elevated temperature, i.e. the kind of temperature encountered in a fire situation. The ceramic forming composition may be non-silicone polymer-based, silicone polymer-based or include a base composition comprising a blend of silicone and non-silicone polymers. The compositions may include a variety of inorganic components capable of yielding a ceramic by reaction at elevated temperature. The compositions may also contain additional functional additives such as flame retardants, etc.

The insulating layer preferably is a ceramic forming composition which forms a self supporting ceramic layer upon exposure to the temperatures normally experienced during a fire. International Application No. PCT/AU2003/00968, the whole contents of which are incorporated herein by reference, describes a fire resistant composition which comprises a silicone polymer, 5-30 wt. % mica and 0.3-8 wt. % glass additive based on the total weight of the composition. It is preferable that the ceramic forming layer exhibits little or no dimensional change during and after exposure to elevated temperatures. A suitable ceramic forming material is disclosed in aforementioned International Application No. PCT/AU2003/01383, the whole contents of which are incorporated herein by reference. This patent application describes a composition which contains an organic polymer, a silicate mineral filler and a fluxing agent or precursor resulting in a fluxing agent in an amount of from 1-15 wt. % of the resulting residue.

In accordance with a second aspect of the invention, there is provided a method of producing a cable comprising the steps of extruding an insulating layer onto a conductor, the insulating layer forming a self supporting ceramic when exposed to an elevated temperature, and extruding at least one auxiliary layer which is transformable during exposure to the temperatures associated with fire to enhance the physical properties of the ceramic forming layer. Preferably the at least one auxiliary layer is co-extruded with the insulating layer.

Preferably the properties enhanced by the auxiliary layer are at least one of:

i) the mechanical strength of the combined layers after exposure to fire;

ii) the structural integrity of the ceramic forming layer after exposure to fire;

iii) the resistance to the ingress of water of the combined layer after exposure to fire; and iv) the electrical or thermal resistance of the combined layers during and after exposure to fire.

In a further aspect of the invention, there is provided a method of designing a cable comprising the steps of selecting an insulating layer for extrusion onto a conductor, the insulating layer forming a self supporting ceramic layer when exposed to the elevated temperatures experienced during a fire, determining the properties of the ceramic forming layer before, during and after exposure to a fire and selecting a material for a secondary layer which enhances the physical properties of the ceramic forming layer and extruding the ceramic forming layer and the at least one auxiliary layer onto a conductor. Preferably the ceramic forming layer and at least one auxiliary layer are co-extruded onto the conductor.

The properties which the at least one auxiliary layer may be chosen to enhance on the ceramic forming layer are:

i) the mechanical strength of the combined layers after exposure to an elevated temperature;

ii) the maintenance of the structural integrity of the ceramic forming layer after exposure to an elevated temperature;

iii) the resistance to the ingress of water to the conductor after exposure to an elevated temperature; and iv) the electrical or thermal resistance of the combined layers during and after exposure to fire.

While the above aspects of the invention will generally be discussed with reference to cables, cable design and cable manufacture, it would be appreciated by those skilled in the art that the invention is equally applicable to the design of fire performance articles for other applications where the product comprises a metal substrate and at least one protective ceramic forming layer or coating and the article is required to perform during and after exposure to a fire. Specific examples of practical situations where this invention may be applied include, but are not limited to seals for fire protection that are in contact with metal substrates; gap fillers (i.e. mastic applications for penetrations); fire protection for metal doors, bulkheads, flooring and other structures on marine vessels, trains, aeroplanes, trucks and automobiles; fire partitions, screens, ceilings and wall linings in buildings; metal enclosures for electrical equipment either within buildings or outdoors; structural steel framework for multi-floored buildings to insulate the frame and allow it to maintain the required load bearing strength for an increased time; coatings for building ducts; fire barriers for flammable material storage areas such as fuel and ammunition depots, refineries and chemical processing plants; and protection of military vehicles, including ships, from the effects of incendiary charges.

Hence in other aspects of the invention, fire performance articles, methods of producing fire performance articles and methods of designing fire performance articles are included. The articles comprise a metal substrate, an insulating or protective layer which forms a ceramic when exposed to an elevated temperature and at least one heat transformable layer which enhances the physical properties of the insulating or protective ceramic forming layer when exposed to an elevated temperature.

When designing a cable or fire performance article comprising at least one ceramic forming layer and a metal substrate, the deficiencies of the combination when exposed to fire are determined for its application and one or more heat transformable layers are selected to overcome these deficiencies. Hence the properties of the one or more heat transformable or auxiliary layers enhance the properties of the ceramic forming layer in the intended application.

One problem which may be encountered with the use of the ceramic forming materials which form a ceramic after exposure to elevated temperatures, is the strength of the ceramic material during and after exposure to fire.

Accordingly in one preferred embodiment of the invention, the at least one heat transformable layer is a strength layer, preferably co-extruded onto the ceramic forming layer. In order to provide the required strength characteristics at least during and after exposure to an elevated temperature, the at least one heat transformable layer may comprise a second ceramic forming layer. The minimum requirements for this layer are that it forms a ceramic that is stronger than that formed by the insulating or protective ceramic forming layer, that the resulting ceramic is self supporting and it undergoes no appreciable reduction in dimensions when converted to a ceramic. This layer can function as an additional insulation layer or as a sheathing layer in the cable application. This second ceramic forming layer preferably comprises an organic polymer, an inorganic filler which is preferably a mineral silicate and an inorganic phosphate. More preferably the second ceramic forming layer also contains aluminium hydroxide. The preferred inorganic phosphate is ammonium polyphosphate. This layer is preferably not in contact with the metal conductor or metal substrate to minimize the likelihood that the inorganic phosphate will affect the insulating properties of the cable or undergo adverse reactions with the metal substrate.

One problem which may be encountered with the use of materials which form a ceramic after exposure to elevated temperatures, eg cable insulation materials, is that the normal operational strength of the material, i.e. before firing, may be less than desirable for the intended application. Accordingly, the at least one heat transformable layer may be an operational strength layer (i.e. a layer which has superior mechanical properties under normal operating conditions), preferably co-extruded onto the ceramic forming layer. The primary use of these layers is to provide the cable with the level of robustness required to position and secure the cables in an installation and to allow the composite insulation to meet the required Standards. Due to the nature of materials which are used in the operational strength layer, these layers are not required to assist the cable during or after exposure to the elevated temperatures usually experienced in a fire. The operational strength layer can continue to provide strength during or after exposure to such elevated temperatures if it is also a second ceramic forming layer. As described later, the operational strength layer may also be a glaze forming layer.

The minimum thickness of the second ceramic forming layer is dictated by the thickness of the conductor and ceramic forming insulation layer, with thicker conductors and insulation layers requiring thicker layers for the second layer to maintain structural integrity.

It is believed that the inorganic phosphate in the second ceramic forming layer decomposes at a temperature at or below the decomposition temperature of the other components to phosphoric acid. In the case of ammonium polyphosphate, ammonia is also a decomposition product. The phosphoric acid dehydrates any organic material in its proximity forming a carbonaceous char which turns into a ceramic at a later stage, while the ammonia contributes to forming a desirable level of porosity.

The ceramic forming composition of the preferred second ceramic forming layer comprises:

at least 15% by weight based on the total weight of the composition of a polymer base composition comprising at least 50% by weight of an organic polymer;

20-40% by weight of an inorganic phosphate, preferably, ammonium polyphosphate based on the total weight of the composition, and at least 15% by weight of an inorganic refractory filler, preferably a silicate mineral filler, based on the total weight of the composition.

The second ceramic forming layer may further comprise 10-20% by weight additional inorganic fillers or additives including at least one selected from the group of hydroxides or oxides of magnesium or aluminium.

The preferred additional filler or additive is aluminium hydroxide, preferably in the amount of 10-20% by weight.

The second ceramic forming layer is also required to form a self-supporting and stronger porous ceramic (typically having porosity of between 20 vol % to 80 vol %) when exposed to fire rating temperatures and at least 40% of its total composition will be inorganic fillers.

An organic polymer is one which has an organic polymer as the main chain of the polymer. For example, silicone polymers are not considered to be organic polymers; however, they may be usefully blended with the organic polymer(s), as the minor component, and beneficially provide a source of silicon dioxide (which assists in formation of the ceramic) with a fine particle size when they are thermally decomposed. The organic polymer can be of any type, for example a thermoplastic polymer, a thermoplastic elastomer, a crosslinked elastomer or rubber, a thermoset polymer. The organic polymer may be present in the form of a precursor composition including reagents, prepolymers and/or oligonomers which can be reacted together to form at least one organic polymer of the types mentioned above.

The organic polymer component can comprise a mixture or blend of two or more different organic polymers.

Preferably, the organic polymer can accommodate the high levels of inorganic additives required to form the ceramic, such as the ammonium polyphosphate, aluminium hydroxide and silicate mineral filler, whilst retaining good processing and mechanical properties. It is desirable in accordance with the present invention to include in the fire resistant compositions high levels of inorganic filler as such compositions tend to suffer reduced weight loss on exposure to fire when compared with compositions having lower filler content. Compositions loaded with relatively high concentrations of ammonium polyphosphate, aluminium hydroxide and silicate mineral filler are therefore less likely to shrink and crack when ceramified by the action of heat.

It is also advantageous for the chosen organic polymer not to flow or melt prior to its decomposition when exposed to the elevated temperatures encountered in a fire situation. The most preferred polymers include ones that are cross-linked after the fire resistant composition has been formed, or ones that are thermoplastic but have high melting points and/or decompose to form a ceramic near their melting points; however, polymers that do not have these properties may also be used. Suitable organic polymers are commercially available or may be made by the application or adaptation of known techniques. Examples of suitable organic polymers that may be used are given below but it will be appreciated that the selection of a particular organic polymer will also be impacted by such things as the additional components to be included in the fire resistant composition, the way in which the composition is to be prepared and applied, and the intended use of the composition.

As indicated, organic polymers that are suitable for use with this invention include thermoplastic polymers, thermoset polymers, and (thermoplastic) elastomers. Such polymers may comprise homopolymers and copolymers of polyolefins.

The organic polymers that are particularly well suited for use in making coatings for cables are commercially available thermoplastic and crosslinked olefin based polymers, co- and terpolymers of any density. Co monomers of interest will be well known to those skilled in the art. Of particular interest are commercially available thermoplastic and crosslinkable polyethylenes with densities from 890 to 960 kg/litre, copolymers of ethylenes of this class with acrylic, vinyl and other olefin monomers, terpolymers of ethylene, propylene and diene monomers, so-called thermoplastic vulcanisates where one component is crosslinked while the continuous phase is thermoplastic and variants of this where all of the polymers are either thermoplastic or crosslinked by either peroxide, radiation or so-called silane processes.

The organic polymer is present in the polymer base composition in an amount of at least 50% by weight. This facilitates loading of the polymer base composition with the additional components without detriment to the processability of the overall composition. As noted the polymer base composition may include a silicone polymer. However, in this case the organic polymer would usually be present in the polymer base composition in a significant excess when compared with the silicone polymer. Thus, in the polymer base composition the weight ratio of organic polymer to silicone polymer may be from 5:1 to 2:1, for instance from 4:1 to 3:1. In terms of weight percentage, if present, the silicone polymer might generally be present in an amount of from 2 to 15% by weight based on the total weight of the formulated fire resistant composition. When a combination of organic and silicone polymers are used, high concentrations of silicone polymer can present processing problems and this should be taken into account when formulating compositions in accordance with the present invention.

The upper limit for the amount of polymer base composition in the fire resistant composition tends to be influenced by the desired properties of the formulated composition. If the amount of the polymer base composition exceeds about 60% by weight of the overall composition, it is unlikely that a cohesive, strong residue will be formed during a fire situation. Thus, the polymer base composition generally forms from 15 to 60%, preferably from 20 to 50%, by weight of the formulated fire resistant composition.

The compositions in accordance with this embodiment of the present invention also include a silicate mineral filler as an essential component. Such fillers typically include alumino-silicates (e.g. kaolinite, montmorillonite, pyrophillite-commonly known as clays), alkali alumino-silicates (e.g. mica, felspar, spodumene, petalite), magnesium silicates (e.g. talc) and calcium silicates (e.g. wollastonite). Mixtures of two or more different silicate mineral fillers may be used. Such fillers are commercially available. Silicon dioxide (silica) is not a silicate mineral filler in the context of the present invention.

The ceramic forming compositions of the second layer includes at least 15% by weight, preferably at least 25% by weight silicate mineral filler. The maximum amount of this component tends to be dictated by the processability of the composition.

In addition to the mineral silicate fillers, a wide variety of other inorganic fillers may be added. Preferred inorganic fillers are hydroxides of magnesium and aluminium or their oxides.

Also inorganic fibres which do not melt at 1000[deg.] C. can be incorporated, including aluminosilicate fibres. This may lead to a reduction in dimensional changes at elevated temperature and/or improved mechanical properties of the resulting ceramic.

Usually, after exposure at elevated temperature (to 1000 [deg.] C.) the residue remaining will generally constitute at least 40%, preferably at least 55% and more preferably at least 70%, by weight of the composition before pyrolysis. Higher amounts of residue are preferred as this may improve the ceramic strength at all temperatures.

In order to improve the electrical or thermal resistance of the ceramic forming layer during and after exposure to fire the at least one heat transformable layer can be a functional layer in the normal operational use of the cable or article (i.e. before firing) which forms a weaker self supporting ceramic than that formed by the insulating or protective layer. For example the use of a sheathing layer of this type in a cable design has benefits over the use of a conventional sheathing layer as it will increase the thickness, and therefore the electrical insulative properties, of the residual ceramic coating remaining after the cable has been exposed to fire.

A specific problem with the application of a ceramic forming composition onto a metal conductor in a cable design is that during exposure to elevated temperatures and during subsequent cooling, the metallic conductor will expand and contract at a different rate from the ceramic which is formed during the heating process. Thus, even if the ceramic shows good shape retention during formation, this difference in thermal expansion and contraction causes the often brittle ceramic to crack and may lead to dislodgement of part of the insulative ceramic coating, exposing the conductor and compromising circuit integrity. This cracking of the ceramic layer tends to be most pronounced during the cooling stage. The problem is accentuated when the ceramic bonds strongly to the conductor surface, or oxide layer formed on the surface of the conductor (during the fire). For example with copper conductors, this difference in thermal expansion can lead to fracture of the cuprous oxide/cupric oxide interface and dislodgement of pieces of ceramic bonded to the cupric oxide. Whilst this problem has been described with particular reference to metallic conductors used in cable applications, it will be apparent to those skilled in the art that this problem will arise in any situation where a metal substrate is coated with the type of fire resistant composition described because of the different coefficients of thermal expansion of the metal substrate and the ceramic formed when the composition is exposed to elevated temperatures. The extent of the problem will depend on the magnitude of the differences in coefficient of thermal expansion of the ceramic and metal and the strength of the bond formed on the interface.

Hence in another embodiment of the invention, the problem of the mismatch between the coefficients of thermal expansion of a metal substrate which is being protected against fire and the ceramic material which offers protection to the substrate is addressed.

In this embodiment of the invention, the at least one heat transformable layer is a sacrificial layer provided on the metal substrate, the layer being formed of a composition comprising an organic polymer and an inorganic filler, wherein the sacrificial layer decomposes at or below the elevated temperature, resulting in formation of a layer of the inorganic filler between the substrate and the ceramic such that bonding of the ceramic to the substrate is minimised or prevented.

Use of the sacrificial layer in this way ensures that the metal substrate and formed ceramic remain separated from each other by a layer which minimises or avoids adhesion of the ceramic to the substrate. The fact that the inorganic filler at least is non adherent to the metal substrate or ceramic results in a reduced tendency of the ceramic to crack and dislodge during cooling, because it relieves stresses resulting from the differences in the coefficients of thermal expansion between the substrate and the ceramic.

The inorganic filler remaining after decomposition of the sacrificial layer allows the substrate and formed ceramic to expand and contract independently. In electrical cable applications two consequences of the resulting reduced crack formation in the ceramic layer are that the exposure of the bare conductor is reduced and there are reduced pathways for ingress of water. Thus the inclusion of a sacrificial layer in the design enhances resistance to circuit failure by electrical shorting during exposure to fire and on exposure to water. In this case the inorganic filler used preferably has high electrical resistance, thereby further assisting circuit integrity. In all cases, low density, powdery nature of the residual filler beneficially provides a barrier to heat transfer, i.e. the residual filler is thermally insulating.

The sacrificial layer is typically formed of a composition comprising an organic polymer and an inorganic filler. Here the term "organic polymer" embraces a variety of polymers which satisfy the following criteria. Firstly, the organic polymer must be one which may be decomposed at a temperature typically encountered in a fire situation to leave little or no solid residue. The organic polymer decomposes at or below the temperature at which the ceramic in the ceramic forming layer is formed. Secondly, the organic polymer must be capable of being loaded with suitable levels of the inorganic filler (typically in the range 25-75% of the weight of the total composition, and preferably more than 50%) whilst retaining good processability. The processability of the composition of the sacrificial layer is important, particularly if the composition is to be extruded as is the case in cable applications. It is important that the organic polymer can accommodate sufficiently high levels of inorganic additive such that a substantially continuous layer of inorganic filler remains on the substrate surface after thermal decomposition of the sacrificial layer. The inorganic filler is required to separate the substrate and formed ceramic as described above and, if insufficient inorganic additive is present in the organic polymer, the additive may not fulfil its intended role of preventing direct contact between the substrate and the formed ceramic. The same problem can arise if the inorganic filler is not dispersed homogeneously in the organic polymer. Some degree of contact between the substrate and ceramic may be tolerated in certain applications more so than in others. Electrical cable applications require a continuous layer of inorganic filler between the conductor and ceramic.

It is also important that the polymer be unreactive towards the inorganic filler at elevated temperature as this may yield reaction products which adhere to the substrate and/or ceramic. Suitable organic polymers are commercially available or may be made by the application or adaptation of know techniques. Examples of suitable organic polymers that may be used are given below.

Useful thermoplastic polymers may be selected from homopolymers of olefins as well as copolymers of one or more olefins. Specific examples of suitable polymers include homopolymers of ethylene, propylene, butene-1, isobutylene, hexene, 1,4-methylpentene-1, pentene-1, octane-1, nonene-1 and decene-1. These polyolefins can be prepared using peroxide, Ziegler-Natta or metallocene catalysts, as is well known in the art. Copolymers of two or more of these olefins may also be employed. The olefins may also be copolymerised with other monomer species such as vinyl or diene compounds. Specific examples of copolymers which may be used include ethylene-based copolymers, such as ethylene-propylene copolymers (for example EPDM), ethylene-butene-1 copolymers, ethylene-hexene-1 copolymers, ethylene-octene-1 copolymers, ethylene-butene-1 copolymers and copolymers of ethylene with two or more of the abovementioned olefins.

The thermoplastic polyolefin may also be a blend of two or more of the abovementioned homopolymers or copolymers. For example, the blend can be a uniform mixture of one of the above systems with one or more of polypropylene, high pressure low density polyethylene, high density polyethylene, polybutene-1 and polar monomer-containing olefin copolymers such as ethylene/acrylic acid copolymers, ethylene/methyl acrylate copolymers, ethylene/ethyl acrylate copolymers, ethylene/butyl acrylate copolymers, ethylene/vinyl acetate copolymers, ethylene/acrylic acid/ethyl acrylate terpolymers and ethylene/acrylic acid/vinyl acetate terpolymers.

As noted, the organic polymer chosen will in part depend upon the intended use of the composition. For instance, in certain applications a degree of flexibility is required of the composition (such as in electrical cable coatings) and the organic polymer will need to be chosen accordingly based on its properties when loaded with the inorganic filler. Polyethylenes and ethylene propylene elastomers have been found to be particularly useful for compositions for cable coatings. Also in selecting the organic polymer account should be taken of any noxious or toxic gases which may be produced on decomposition of the polymer. The generation of such gases may be more tolerable in certain applications than others.

After decomposition of the organic polymer a coating of the inorganic filler will remain on the substrate. As noted, for certain applications (e.g. electrical cables) it is desirable that this coating is continuous and mechanically weak. The function of the inorganic additive is to minimise or prevent adhesion between the substrate and ceramic formed at elevated temperature. With this in mind it is important that the inorganic filler is unreactive (with itself, the substrate and the ceramic-forming composition) at the temperatures likely to be encountered in a fire situation. Any reactions involving the inorganic filler may lead to the formation of products which impair the intended role of the inorganic filler.

The inorganic filler used in this embodiment may be any inorganic material which may be homogenously dispersed in the organic polymer and which will be inert at the temperatures likely to be encountered in a fire situation. The use of the inorganic filler is central to the present invention. Use of an organic polymer alone as the sacrificial layer will not avoid adhesion between the substrate and formed ceramic. In this case the polymer would simply decompose leaving little or no residue. The ceramic would then be in direct contact with the substrate resulting in the problems described above.

Desirably, the inorganic filler has a high melting temperature, for example in excess of 1000[deg.] C. and, preferably, in excess of 1500[deg.] C. The cost of the additive is also likely to be a factor. Examples of suitable inorganic additives include metal oxides, metal hydroxides, talc and clays. Specifically, as well as talc and clays which may be used, mention may be made of alumina, aluminium hydroxide, magnesium oxide, magnesium hydroxide, calcium silicate and zirconia. Combinations of two or more inorganic fillers may be used provided that the combination is inert at the kind of temperatures likely to be encountered in a fire situation. Most preferably the inorganic filler for use in cable applications is magnesium hydroxide as it beneficially confers very low electrical conductivity.

The sacrificial layer may include one or more additional functional components provided that these do not interfere with the intended role of the inorganic filler. Such additional components include flame retardant materials and materials that reduce thermal and/or electrical conductivity. The sacrificial layer can also be an operational strength layer.

The composition used for the sacrificial layer may be prepared by simple blending of the individual components. Any conventional compounding apparatus may be used. If the composition has relatively low viscosity, it may be processed using dispersing equipment, for instance of the type used in the paint industry. Materials useful for cable applications are of higher viscosity (higher molecular weight) and may be processed using a two roll mill, internal mixers, twin-screw extruders and the like. If the organic polymer is to be crosslinked, some heating of the polymer will be required in the presence of a suitable crosslinking agent. Conventional crosslinking agents may be used.

Specific examples of practical situations beyond cable applications where this embodiment of the invention may be applied include but are not limited to firewall linings and for ferries, trains and other vehicles, fire partitions, screens, ceilings and linings, coatings for building ducts; gap fillers (i.e. mastic applications for penetrations); structural fire protection [to insulate the structural metal frame of a building to allow it to maintain its required load bearing strength (or limit the core temperature) for a fixed period of time].

This embodiment of the present invention is especially useful for the coating of conductors, i.e. in electrical cable applications. The invention is therefore suitable for the manufacture of electrical cables that can provide circuit integrity in the case of fire. In the design of such cables the composition for the sacrificial layer and ceramic-forming layer can be extruded directly over conductors. This extrusion may be carried out in a conventional manner using conventional equipment. The thickness of the sacrificial layer will usually be from 0.2 to 2 mm, for example from 0.4 to 1.5 mm. The thickness of the ceramic forming layer will depend upon the requirements of the particular standard for the size of conductor and operating voltage. Typically the insulation will have a thickness from 0.6 to 3 mm. For example, for a 35 mm<2> conductor rated at 0.6/1 kV to Australian Standards would require an insulation thickness of approximately 1.2 mm. In non-cable applications the appropriate thicknesses of the sacrificial and ceramic forming layers may be determined by experimental testing.

In another preferred embodiment of the invention, the at least one heat transforming layer is a glaze forming layer comprising a component which after exposure at the elevated temperature and cooling forms a glaze layer which is substantially impervious to water. The glaze forming layer is provided adjacent and in direct physical contact with the insulating or protective layer which forms a ceramic. It has also been found that the glaze formed after exposure to elevated temperatures may enhance the structural integrity and strength of the ceramic layer formed. Hence, the glaze forming layer may also serve as an operational strength layer. In this embodiment of the invention, a distinct glaze forming component forms a glaze layer which acts as a barrier to any water which may be present in the surroundings. For example, in a cable design this glaze layer prevents access of water to the conductor by being substantially impervious to water. The glaze layer may include minor defects such as discontinuities, pores and cracks. These are preferably at a level such that any water which is able to pass through the glaze is negligible. Preferably the glaze layer is coherent and continuous so that no water is able to pass through the layer.

The glaze-forming layer includes a component which is capable of forming a water impervious layer after heating at the kind of elevated temperatures encountered in a fire followed by cooling. Cooling may take place naturally or as a result of specific measures taken to extinguish the fire, such as water spraying. One or more glaze-forming components may be employed. In general terms, the glaze layer may be formed by softening/melting and coalescence of glaze-forming component(s) to form a continuous and coherent glaze. The glaze solidifies on cooling. It follows from this explanation that the glaze-forming component(s) must soften/melt at elevated temperature such that individual component particles may amalgamate to form the glaze layer. Ideally, the glaze-forming components form a liquid which has a suitable viscosity and which can flow (to a limited extent) in order to achieve formation of the glaze layer. Although not essential, chemical reaction between the glaze-forming components may be responsible at least in part for formation of the glaze layer. Other additives may be present, such as refractory extenders.

For obvious reasons, the glazing layer effect would not be observed if the glaze-forming compositions consist of components which do not undergo the necessary coalescence and/or reaction at the kind of temperatures associated with a fire situation. It is desirable that the glaze-forming layer includes one or more glaze-forming components which are capable of forming a suitable glaze at temperatures as low as 500[deg.] C. As copper melts at 1080[deg.] C., it is unnecessary that the glaze-forming compositions used in cable applications include glaze-forming components which are "activated" at temperatures higher than this.

As noted, it is desirable that the glaze-forming component forms a liquid at the kind of temperatures encountered in a fire situation. At these temperatures the viscosity of the liquid component may be important. If the viscosity is too low, the liquid is likely to flow too readily and this may cause depletion of glaze in certain areas and accumulation in others. This can lead to defect formation. If the glaze conducts electricity and is of low viscosity, it may also cause electrical conductivity problems in cables. For instance, when the glaze-forming layer is provided over a ceramic forming insulation layer the glaze formed may flow through any pores and/or cracks present in the insulating (ceramic) layer establishing a conductive path from the conductor to the external surface of the ceramic forming layer. On the other hand, if the liquid is too viscous and has a high surface tension at elevated temperatures, formation of a coherent and continuous layer of glaze that has suitable wetting and adherent properties may be inhibited. When provided over a ceramic forming layer, it is desirable that the glaze wets and adheres well to the ceramic layer formed at elevated temperature. This may be important to achieving the strength benefit mentioned earlier. The liquid glaze formed during heating preferably has low electrical conductivity, a low surface tension and moderately high viscosity at elevated temperatures, and the glaze-forming component may be selected accordingly.

There may be advantages associated with using a mixture of two or more glaze-forming components. For instance, it has been observed that a relatively low melting point component can be absorbed into an underlying ceramic forming layer at high temperature. This effect can be reduced by mixing the relatively low melting component with a glaze-forming component which melts at a higher temperature. The use of mixtures of glaze-forming component may also increase the temperature range over which a suitable glaze layer may be formed.

Bearing in mind the various factors described above, the glaze-forming component may be selected from:

a) Combinations of two or more materials that react/combine to form a molten glass at elevated temperature. Some typical examples of such combinations include silicates (such as mica and feldspar), phosphates, borates and/or their precursors mixed with alkali oxides, alkaline earth oxides, certain transition metal oxides (e.g. zinc oxide) and/or their precursors. By "precursors" is meant any compound which yields the material (in compound form) on heating.

b) Glasses, or mixtures of glasses, that soften/melt at elevated temperature. For cable applications it is desirable that the glass has low electrical conductivity at elevated temperatures. The glass therefore preferably has low alkali metal content.

c) Combinations of (a) and (b).

d) Combinations of (c) with up to 75% of a refractory filler such as, but not limited to, alumina, zirconia, rutile, magnesia and lime.

It is possible, but by no means essential, that the glaze-forming layer includes additional components and this will depend upon the way in which the layer is to be provided as part of the overall design. In one embodiment the glaze-forming layer consists solely of the component which is capable of forming the glaze. In this embodiment, in a cable design the component may be applied directly to the surface of the conductor (and be covered by the ceramic forming layer) and/or to a layer covering the conductor, typically the ceramic forming layer, of the cable being manufactured.

The component may be applied by an electrostatic deposition technique in which a substrate to be coated (i.e. the conductor or other cable layer) is earthed and the component electrostatically charged. Electrostatic forces cause the component to be attracted to and lodged on the surface of the substrate. In practice, application of the glaze-forming layer takes place as part of a continuous process for formation of a finished cable. If the glaze-forming layer contains a resin, high output IR lamps or other sources of heating may be used to melt the resin so that it flows forming a smooth coating. This coating can subsequently be crosslinked either by continuing the heat application, or by UV cure systems. This can also be done in the course of applying extruded layers to the cable in a continuous operation.

The amount and distribution of glaze-forming component is such as to allow a layer of glaze to be formed which is substantially impervious to water. The particle size, fibre length, aspect ratio or fibre diameter as the case may be of the glaze-forming component will influence this. When particles of glaze-forming component are used, the average particle size is 200 microns or less, preferably 50 microns or less and, more preferably, 20 microns or less. The glaze-forming composition may comprise a glaze-forming component homogeneously dispersed in a suitable carrier. The composition may be formed by known blending techniques. The carrier is intended to enable application of the composition in an essentially uniform layer. An important characteristic of the carrier is that it has the capacity to be loaded with a sufficient amount of the glaze-forming component such that a suitable glaze may be formed at elevated temperature, whilst retaining suitable processability to allow the composition to be applied, for example as a layer of a cable. Thus, the carrier must have satisfactory Theological properties. Desirably, the carrier also has the ability to wet both the components dispersed in it and the substrate to which the glaze-forming composition is to be applied, and develops high strength when cooled or cured (depending upon the nature of the carrier). It is also important that the carrier does not include anything which interferes with glaze formation at elevated temperature. Ideally, the carrier is one which thermally decomposes at this temperature leaving no residue. The presence of residue may lead to discontinuities and defects in the glaze layer and can cause conductivity problems if the residue is electrically conductive. It is also preferable that heating or decomposition of the carrier does not lead to generation of excessive amounts of gaseous by-products. Furthermore, the carrier preferably decomposes at temperatures below that at which formation of the glaze commences.

In cable applications the carrier may be a thermoplastic polymer which is conventionally used to provide a layer of a cable, such as a sheathing layer. In this case the carrier is loaded with a suitable amount of glaze-forming component and extruded in a conventional manner to form a glaze-forming layer. It is preferred that the carrier used sets to provide a non-tacky layer as quickly as possible since the glaze-forming layer is generally applied as part of a continuous process involving application (by extrusion normally) of an additional layer over the glaze-forming layer. The application of this particular methodology is less useful if the carrier polymer does not burn out cleanly at elevated temperature.

In a process where rapid curing is required, it is preferred that the carrier may be heat-cured or radiation-cured. Thus, the carrier component of the glaze-forming composition may be selected from homopolymers and copolymers of alkyl acrylates, alkyl methacrylates, low molecular weight polyurethanes that are functionalised with acrylic double bonds (referred as urethane acrylates) and silicone resins which can be cured by UV radiation followed by atmospheric moisture as secondary cure system. Another class of radiation curable resins suitable for use as the carrier component is polyesters with acrylate functionalities.

In cable applications the rheology of the glaze-forming composition should be such that it enables the composition to be extruded by conventional techniques to form a smooth and continuous layer. The viscosity of the carrier used and the loading of glaze-forming and, possibly additional, components will be significant here. Purely by way of illustration, the carrier resin may have a viscosity in the range of 15-1500 cP at 25[deg.] C., more preferably from 30-400 cP at 25[deg.] C.

As a further alternative, the glaze-forming component may be provided on the outer surface of the cable by contacting the latter with a slurry of glaze-forming component homogeneously dispersed in a suitable medium. The slurry may be applied by dipping or brushing. Preferably, to achieve rapid fixing in position of the glaze-forming layer, the medium in which the glaze-forming component is dispersed is quick-drying or volatile. The slurry can also contain a geopolymer composition which usually consists of an aluminosilicate dissolved in an alkali metal silicate solution, such as potassium silicate. On heating, the geopolymer forms a glass. Furthermore, it is also possible to make use of sol-gel technology to coat a surface layer of glass-forming composition in this embodiment.

The weight ratio of the glaze-forming component to carrier/medium usually is within the range of 0.9:1 to 1.2:1. It is important that this ratio is kept as high as possible to facilitate the formation of a continuous glaze layer.

Once applied and suitably fixed, the glaze-forming layer is usually covered by at least one additional layer of the cable. This layer may be applied by extrusion downstream of the site at which application of the glaze-forming component takes place. For instance, the glaze-forming layer may be provided on an insulation layer in direct contact with the conductor and a layer of sheathing polymer extruded over the glaze-forming layer immediately after application thereof. Provision of a layer over the glaze-forming layer may also help to fix the latter in position. A cut-resistant layer may also be provided between the glaze-forming layer and the sheathing layer. Such a cut-resistant layer may be extruded over the glaze-forming layer and the sheathing layer then extruded over the cut-resistant layer.

Depending on the fraction of glaze-forming component in the coating composition, the glaze-forming layer usually has a thickness of 500 microns or less, preferably 250 microns or less and, more preferably, 100 microns or less. For economy, it is preferred to use the minimum amount (and thus thickness) of glaze-forming component in order to achieve the desired result, as described above. Typically, the thickness of the glaze-forming layer is only a fraction of the thickness of the ceramic forming layer which is used. For instance, the thickness of the glaze-forming layer is generally 50% or less than the thickness of the ceramic forming layer. In practice, the ceramic forming layer may be say 0.8 mm and the glaze-forming layer 0.4 mm in thickness. One skilled in the art may of course modify these relative thicknesses in order to optimise the effect of each layer.

Suitable glaze-forming components, carriers and mediums for use in practice of the present invention are commercially available.

The present invention also provides a process of the manufacture of an electrical cable or fire protection article by the techniques described herein.

The compositions of the present invention are especially useful in the coating of conductors. The compositions are therefore suitable for the manufacture of electrical cables that can provide circuit integrity in the case of fire.

Figure 1:
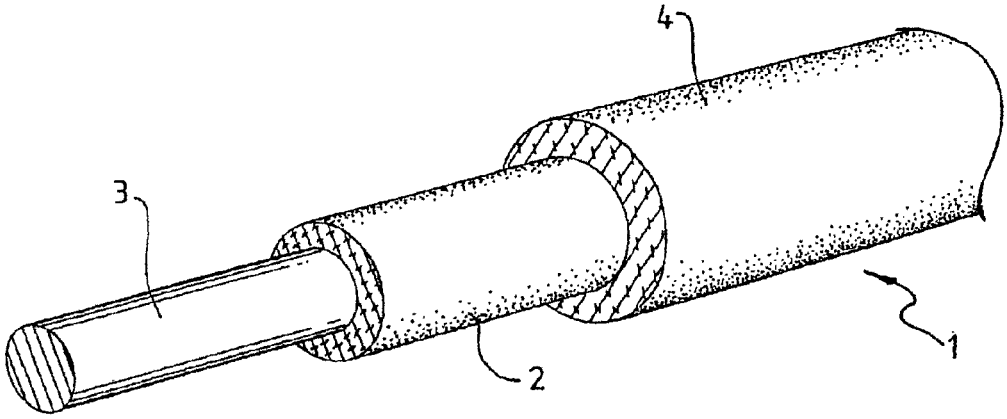
FIG. 1 is a perspective view of a cable having a ceramic forming insulation layer in accordance with the invention.
Figure 2:
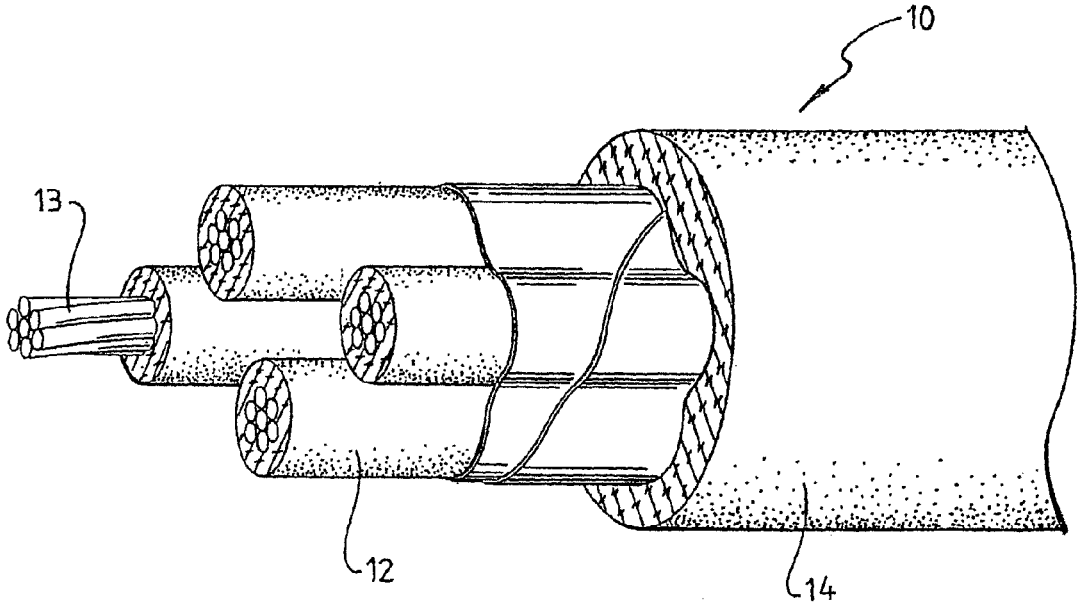
FIG. 2 is a perspective view of a multiconductor cable in which compositions of the invention are used as a sheath.

FIGS. 1 and 2 show single and multiconductor cables 1, 10 respectively which have an insulation layer 2, or layers 12 and having additional heat transformable layers 4, 14. In both of these cable designs, the position of the insulation layer and the heat transformable layer can be interchanged depending on the role of the additional layer.

In the design of such cables the layers can be extruded directly over conductors and the additional layer or layers extruded over an insulation layer or layers. Alternatively, they can be used as an interstice filler in multi-core cables, as individual extruded fillers added to an assembly to round off the assembly, as an inner layer prior to the application of wire or tape armour.

In practice the composition will typically be extruded onto the surface of a conductor. This extrusion may be carried out in a conventional manner using conventional equipment. As mentioned earlier, the thickness of the layer of insulation will depend upon the requirements of the particular standard for the size of conductor and operating voltage. Typically the insulation will have a thickness from 0.6 to 3 mm. For example, for a 35 mm<2> conductor rated at 0.6/1 kV to Australian Standards would require an insulation thickness of approximately 1.2 mm. As noted, cables and fire performance articles can be produced to provide two or more complementary heat transformable layers which exhibit excellent thermal and electrical insulating properties at elevated temperature. The invention enables a cable of elegantly simple design to be manufactured since there is then no need to include as a separate manufacturing step, a distinct layer to confer electrical insulating, strength or water resistant properties. The cable may include other layers such as a cut-resistant layer and/or sheathing layer. However, the cable does not require an additional layer intended to maintain electrical insulation at elevated temperature.

Figure 3:
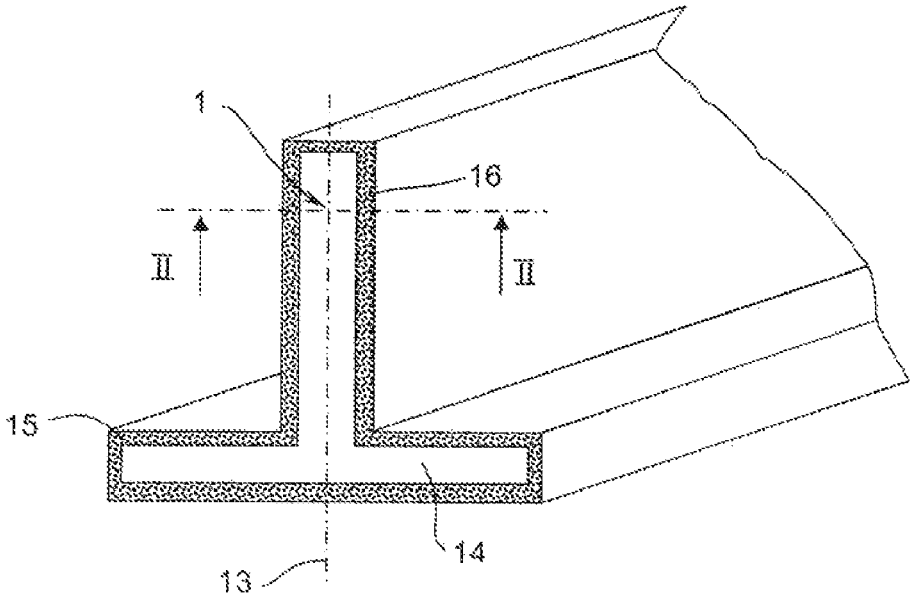
FIG. 3 shows a possible design for a fire performance article 1.
Figure 4:
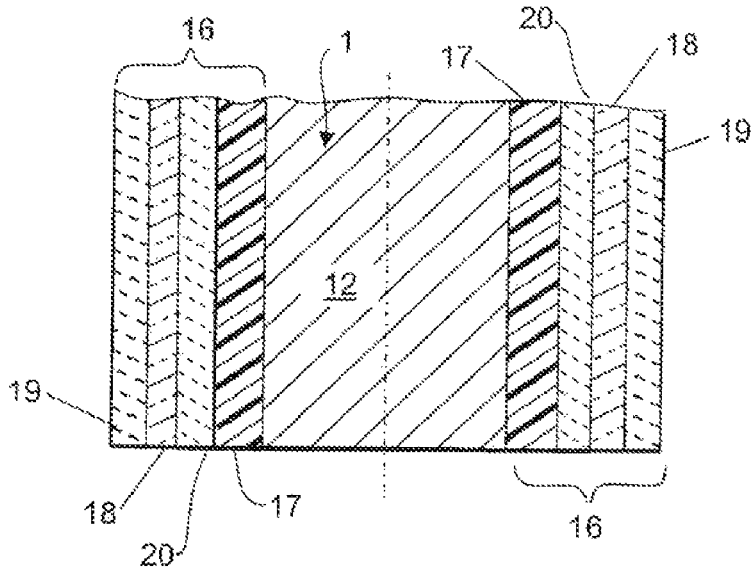
FIG. 4 shows a cross section at the position II in FIG. 3.

In the embodiments shown in FIGS. 3 and 4, the metal substrate 12 has a protective coating 16 which comprises at least one ceramic forming layer 20 and at least one heat transformable layer. Examples of heat transformable layers could be a sacrificial layer 17 with a glazing layer 18 or a layer forming a stronger ceramic 18 or a combination of a glazing layer 18 and a layer forming a stronger ceramic 19.

Embodiment of the present invention is illustrated in the following non limiting Examples.

EXAMPLE 1

A composition was made based on an EP polymer of Composition A that contained ammonium polyphosphate and other minerals as described in this specification. It was found to have slight (2%) expansion after exposure to 1,000[deg.] C. It was also found to have a dense skin in comparison with other ceramic forming compositions and resistant to water after exposure to fire. Compared to the ceramic forming Composition B which did not contain ammonium polyphosphate, it had a higher strength by a factor of 7.5 as measured by three point blending test described in PCT/AU/2003/00183

Cable samples were made using this composition and time tested for electrical resistance, but it was found to be less electrically resistant than the ceramic forming Composition B by a factor of 10.

The benefits that this layer provided in strength and water resistance were then utilised by applying it as an outer layer only over the ceramic forming layer of Composition B.

| | wt. % |
|---|---|
| Composition A | |
| EP Polymer | 18 |
| EVA Polymer | 4.5 |
| Ammonium Polyphosphate | 27 |
| Talc | 25 |
| Alumina Trihydrate | 16 |
| Other Additives (Stabilisers, Coagent, Paraffinic Oil) | 8 |
| Peroxide | 2.5 |
| TOTAL | 100 |
| Composition B | |
| EP Polymer | 19 |
| EVA Polymer | 5 |
| Clay | 10 |
| Talc | 10 |
| Mica | 20 |
| AluminaTrihydrate | 10 |
| Calcium Carbonate | 10 |
| Silicone Polymer | 5 |
| Other Additives, (Stabilizers, Coagent, Paraffinic Oil) | 8.4 |
| Peroxide | 2.6 |
| TOTAL | 100 |

A 1.5 mm<2> conductor, made from 7 plain copper wires of 0.5 mm, bunched, was insulated with 0.5 mm wall thickness of ceramifiable composition B. A second layer of the composition detailed in Composition A was extruded directly over this to provide a composite wall thickness of 1.0 mm. This insulated conductor was assembled with three other lengths of the same insulated conductor by twisting.

The twisted, insulated conductors were then sheathed with a commercially available halogen-free, low-smoke, low-toxicity thermoplastic compound, forming a finished cable. This cable was then subjected to the circuit integrity test of AS/NZS3013:1995.

The cable is connected to a 240 volt power supply forming a circuit via a specified load and then subjected to a furnace test of 2 hours duration with a final temperature of 1,050[deg.] C., and then a water jet spray for 3 minutes.

The cables made as described, with the compositions shown, were able to maintain circuit integrity and thus meet the requirements of this test.

A comparative cable was produced and subjected to the same test using only insulating material of Composition A and was found to perform unsatisfactorily.

EXAMPLE 2

Three 200 mm sections of 35 mm<2> copper conductor were used to make different cable design prototypes. The extrudable compositions examined as sacrificial layers were Composition C (an ethylene propylene rubber heavily filled with predominantly aluminium hydroxide, and containing peroxide) and Composition D (a silicone polymer containing peroxide for thermally induced crosslinking). Composition E (silicone polymer/mica/glass fibre/peroxide 73:20:5:2), which forms a ceramic material when heated at elevated temperatures, was the outer layer in all three prototypes. The prototypes were prepared by simultaneously moulding and curing the composition(s) onto the cable sections. The designs and the layer thicknesses are shown in Table 1.

TABLE 1

| Prototype | Sacrificial Layer Composition (thickness, mm) | Outer Layer (Ceramic farming layer) Composition (Thickness, mm) |
|---|---|---|
| 1 | Nil | E(1) |
| 2C | C(1) | E(1) |
| 2D | D(1) | E(1) |

All three prototype cables were then heated in a furnace to 1000[deg.] C. in air for 30 minutes. They were then removed from the furnace and allowed to cool to room temperature, their behaviour during cooling being monitored.

Prototype cable 1, which had no layer between the conductor and the ceramic forming compositions, showed no visible cracking of the ceramic layer hen it was removed from the furnace. However, during cooling the ceramic insulation gradually cracked and sections spalled off the cable.

Prototype cable 2C (in accordance with the present invention), showed no visible cracking of the ceramic layer when it was removed from the furnace and even after 15 minutes of cooling no cracking or loss of insulation occurred.

Prototype cable 2D, with the silicone polymer interlayer, had with some circumferential cracking when it was removed from the furnace, and after 8 minutes cooling significant cracking had occurred and a large section of insulation from the middle of the cable spalled off the conductor.

Visual and microscopical examination of the cables after the test showed that the ceramic layer in prototype 1 had bonded strongly to the oxide layer on the copper conductor. Thermal expansion mismatch between the conductor and the ceramic resulted in the disintegration of the ceramic layer during cooling with dislodged ceramic pieces attached to a thin layer of copper oxide that had become delaminated from the conductor surface. For prototype 2C a continuous powdery residue in between the conductor and the outer ceramic layer was observed. This residue appeared to have not reacted with or bonded to either the conductor or the ceramified insulation. Thus, it effectively prevented any bond from forming between the conductor and the insulation. Contrasting this, the interlayer in prototype 2D appeared hard and glassy and had bonded to the conductor and the ceramic layer.

EXAMPLE 3

A plain annealed copper stranded conductor made from 19 wires of 1.67 mm<2>was electrically insulated simultaneously with a sacrificial layer based on EP polymer and a silicone elastomer based ceramic forming layer of composition E to an overall wall thickness of 1.2 mm. A similar cable was made with just the silicone elastomer based ceramic forming layer and without the sacrificial layer.

On firing these samples to 1,000[deg.] C., it was observed that a full coverage of the conductor was maintained in both cases.

However, as the samples cooled, the conductor in the sample that did not have a sacrificial layer began to disrupt the ceramic forming layer, due to interactions between the copper oxides of different valence.

This did not occur with the sample made with the sacrificial layer.

EXAMPLE 4

An EP polymer based composition was made with 62% of magnesium hydroxide for use as an inner sacrificial layer of high electrical resistance. The Mg(OH)2 was expected to convert to a powder of MgO on exposure to 1,000[deg.] C., leaving a powdery mass that did not ceramify.

Cable samples made with this material included 35 mm<2> and 1.5 mm<2> plain annealed copper conductors. Testing in a furnace at up to 1,050[deg.] C. resulted in the expected conversion of the Mg(OH)2 to MgO and a powdery layer over the conductor, held in place by the outer ceramic forming layer of composition J (given in Table 3). In comparison with other inner layer materials, this layer was found to provide higher electrical resistivity at 1,000[deg.] C. by a factor of 2.

EXAMPLE 5

In this Example, a glaze-forming composition was made by mixing thoroughly 46 parts by weight of a commercially available UV curable acrylic resin (TRA-coat 15C) having a viscosity of 1175 cPs at 25[deg.] C. with 10 parts by weight of a fine muscovite mica having a mean particle size of approximately 40 [mu]m and 44 parts by weight of glass frit "F" having a softening point of 525[deg.] C. (composition given in Table 2) to produce a homogenous mixture. The glaze-forming composition was then applied over an ceramic forming layer of composition J of a cable sample and also over a sheet of the same ceramic forming insulating material of 25 mm*15 mm*2 mm dimensions using a soft brush. UV curing of the glaze-forming layer was performed using an F-600 lamp (120 W/cm, 365 nm) in air at a conveyor speed of 2 m/min. Samples were cured after one pass through the irradiation unit. The thickness of the glaze-forming layer was in the range of 100-600 microns. The coated samples were then fired in a muffle furnace at 1000[deg.] C. for 30 minutes. On visual inspection the fired samples had no major defects/cracks. The glaze-forming layer was found to have formed a continuous ceramic glaze on the ceramic forming layer upon firing. This glaze layer was impervious to water as revealed by the retention of a water droplet on the glaze for over one minute without permeating into the ceramic forming layer underneath.

EXAMPLE 6

Replacing 9-23 parts by weight of glass frit in the glaze-forming composition described in Example 5 above with zinc borate or boric oxide further improved the imperviousness of the glaze layer to water.

EXAMPLE 7

In this Example, the glaze-forming composition was made by mixing thoroughly 40 parts by weight of an aqueous solution of poly(vinyl alcohol) containing 90% water with 30 parts by weight of glass frit "F" having a softening point of 525[deg.] C. and 30 parts by weight of glass frit "G" having a softening point of 800[deg.] C. and a composition given in Table 2 to produce a homogenous mixture. The glaze-forming composition was then applied over the ceramic forming layer of composition K (given in Table 3) of a cable sample using a soft brush. The composition was allowed to dry in air for two hours. The thickness of the glaze-forming layer was in the range of 150-300 microns. The coated sample was then fired in a muffle furnace at 1000[deg.] C. for 30 minutes. On visual inspection the fired sample had no major defects/cracks. The glaze-forming layer formed a continuous ceramic glaze on the ceramic forming layer upon firing. This glaze layer was impervious to water as revealed by the retention of a water droplet on the glaze for over one minute without permeating into the ceramic forming layer underneath.

EXAMPLE 8

Replacing 10 parts by weight of glass frit "G" in the glaze-forming composition described in Example 7 above with a fine muscovite mica having a mean particle size of approximately 40 [mu]m resulted in a glaze layer that is uniform and impervious to water.

EXAMPLE 9

In this Example, the glaze-forming composition consisted of glass frit "H" (composition given in Table 2) having a softening point of 525[deg.] C. The glass frit powder was applied over the ceramic forming layer of composition K of cable samples by pulling the cables through a vibrating bed of glass frit powder. This application method may not be practical on commercial scale but the end result is essentially the same as would be achieved by the electrostatic deposition method described above. Coated cable samples and non-coated, otherwise identical, cable samples were then fired in a gas fired furnace to 1050[deg.] C. in 2 hours followed by water spraying for 3 minutes according to the Australian Standard AS3013 involving water sprayed at a distance of 2.5 m to 3.0 m at a rate of 12.5 l/min. It was found that the cables coated in accordance with the present invention showed much superior water resistance than the comparison cable without the glaze-forming layer. The latter in fact shorted within 1 minute while the cable with the glaze-forming layer lasted the entire 3 minute period of water spraying. This is believed to clearly demonstrate the effectiveness of the glaze-forming forming layer in reducing the permeation of water into the ceramic forming layer after exposure to high temperature.

TABLE 2

Composition of glass frits given in weight percent of constituent oxides

| Glass Frit | $SiO_2$ | $Na_2O$ | $K_2O$ | $TiO_2$ | $P_2O_5$ |
|---|---|---|---|---|---|
| F | 37.7 | 14.8 | 10.6 | 16.0 | 1.3 |
| G | 39.2 | 2.9 | 2.2 | — | — |
| H | 13.5 | 18.2 | 10.8 | 19.3 | 1.8 |

| Glass Frit | $Al_2O_3$ | CaO | $Fe_2O_3$ | ZnO | $V_2O_5$ | Other |
|---|---|---|---|---|---|---|
| F | 1.2 | 1.0 | 3.0 | — | — | 14.5 |
| G | 5.5 | 5.3 | — | 35.2 | — | 8.7 |
| H | — | — | — | — | 8.7 | 7.7 |

EXAMPLE 10

Compositions were made using high levels of glass frit F in different carrier polymers, including acrylic UV curable, and EP polymers. These compositions were applied as thin layers (0.2-0.4 mm) over ceramic forming composition K that had been extruded over 1.5 mm<2> (7/0.5 mm bunched) plain annealed copper conductors. It was found that, while a suitable glazing layer could be provided, the materials in this layer caused an unacceptable reduction in electrical resistance of the ceramified insulation at 1,000[deg.] C., making them unsuitable for cable applications.

TABLE 3

| | Composition (weight %) | |
|---|---|---|
| | J | K |
| EP Polymer | 22.4 | 22 |
| Clay | — | 24 |
| Talc | 31 | 14 |
| Mica | 29.1 | 20 |
| Glass frit F | — | 2 |
| Silicone Polymer | 5.8 | 60 |
| Other Additives, (Stabilisers, Coagent, Paraffinic Oil) | 9.4 | 9 |
| Peroxide | 23 | 3 |
| TOTAL | 100 | 100 |

The invention claimed is:

1. A cable comprising:

a) at least one conductor and a plurality of layers about the at least one conductor including:

b) an electrically insulating layer which forms a ceramic when exposed to an elevated temperature comprising a silicone elastomer and c) at least one further layer which is heat transformable to a ceramic under fire conditions comprising:

i) a polymer base composition comprising at least 50% by weight of organic non-silicone polymer; and ii) an inorganic filler.

2. A cable as claimed in claim 1, wherein the inorganic filler of the heat transformable layer comprises an inorganic phosphate and silicate material.

3. A cable as claimed in claim 1, wherein the heat transformable layer comprises from 20%-40% by weight based on the total layer composition of an inorganic phosphate.

4. A cable as claimed in claim 1, wherein the heat transformable layer comprises ammonium polyphosphate in an amount of from 20% to 40% by weight.

5. A cable as claimed in claim 1, wherein the inorganic filler comprises one or more inorganic additives selected from the group consisting of metal oxides, metal hydroxides, talc and clays.

6. A cable as claimed in claim 1, wherein the electrically insulating layer and heat transformable layer are co-extruded onto the conductor.

7. A cable as claimed in claim 1, wherein the cable is substantially free of mica.

8. A fire performance article comprising:

a) a metal substrate and a plurality of layers about the metal substrate including:

b) a layer which forms a ceramic when exposed to an elevated temperature comprising a silicone elastomer and c) at least one further layer which is heat transformable to a ceramic under fire conditions comprising:

i) a polymer base composition comprising at least 50% by weight of organic non-silicone polymer; and ii) an inorganic filler.

9. A fire performance article as claimed in claim 8, wherein the inorganic filler of the heat transformable layer comprises an inorganic phosphate and silicate material.

10. A fire performance article as claimed in claim 8, wherein the heat transformable layer comprises from 20%-40% by weight based on the total layer composition of an inorganic phosphate.

11. A fire performance article as claimed in claim 8, wherein the heat transformable layer comprises ammonium polyphosphate in an amount of from 20% to 40% by weight.

12. A fire performance article as claimed in claim 8, wherein the inorganic filler comprises one or more inorganic additives selected from the group consisting of metal oxides, metal hydroxides, talc and clays.

13. A cable comprising:

a) at least one conductor;

b) an insulating layer formed of a silicone polymer base which forms a ceramic when exposed to elevated temperature; and c) at least one heat transformable layer formed of a non-silicone based polymer which enhances the physical properties of the insulating ceramic forming layers when exposed to an elevated temperature.

14. A cable as claimed in claim 13, wherein the inorganic filler of the heat transformable layer comprises an inorganic phosphate and silicate material.

15. A cable as claimed in claim 13, wherein the heat transformable layer comprises from 20%-40% by weight based on the total layer composition of an inorganic phosphate.

16. A cable as claimed in claim 13, wherein the heat transformable layer comprises ammonium polyphosphate in an amount of from 20% to 40% by weight.

17. A cable as claimed in claim 13, wherein the inorganic filler comprises one or more inorganic additives selected from the group consisting of metal oxides, metal hydroxides, talc and clays.

18. A cable as claimed in claim 13, wherein the electrically insulating layer and heat transformable layer are co-extruded onto the conductor.

19. A cable as claimed in claim 13, wherein the cable is substantially free of mica.

* * * * *